US005301650A

United States Patent [19]

Neumayer et al.

[11] Patent Number: 5,301,650

[45] Date of Patent: Apr. 12, 1994

[54] IGNITION DEVICE FOR INTERNAL COMBUSTION ENGINES

[75] Inventors: Josef Neumayer, Bad Abbach; Werner Gorski, Traunstein, both of Fed. Rep. of Germany

[73] Assignee: Siemens Aktiengesellschaft, München, Fed. Rep. of Germany

[21] Appl. No.: 992,149

[22] Filed: Dec. 17, 1992

[30] Foreign Application Priority Data

Dec. 17, 1991 [EP] European Pat. Off. ..... 91121610

[51] Int. Cl.[5] ..... F02P 3/055

[52] U.S. Cl. ..... 123/609; 123/630

[58] Field of Search ..... 123/609, 618, 630, 644, 123/650, 652

[56] References Cited

U.S. PATENT DOCUMENTS

| | | | |
|---|---|---|---|
| 4,239,024 | 12/1980 | Leichle et al. | 123/609 X |
| 4,248,195 | 2/1981 | Gorille | 123/609 X |
| 4,292,942 | 10/1981 | Katada et al. | 123/609 X |
| 4,362,144 | 12/1982 | Yamaguchi et al. | 123/609 |
| 4,367,722 | 1/1983 | Mizuno | 123/609 X |
| 4,690,123 | 9/1987 | Kimura et al. | 123/609 X |
| 4,757,798 | 7/1988 | Saski | 123/630 X |
| 4,762,110 | 8/1988 | Iwata | 123/609 |

FOREIGN PATENT DOCUMENTS

| | | |
|---|---|---|
| 3924129 | 1/1991 | Fed. Rep. of Germany . |
| 63-61775 | 3/1988 | Japan . |
| 9101447 | 2/1991 | PCT Int'l Appl. . |
| 2012353 | 7/1979 | United Kingdom . |

*Primary Examiner*—Willis R. Wolfe

*Attorney, Agent, or Firm*—Herbert L. Lerner; Laurence A. Greenberg

[57] ABSTRACT

An ignition device for internal combustion engines includes a monitoring device for a closing duration of a primary current circuit of at least one ignition coil, being set into motion simultaneously with an onset of closure of the primary current circuit and opening the primary current circuit again after a monitoring duration has elapsed, in the event that the circuit is still supposed to be closed at that time. The monitoring duration is adjusted as a function of the closing duration to be monitored.

1 Claim, 2 Drawing Sheets

IGNITION DEVICE FOR INTERNAL COMBUSTION ENGINES

Figures 1A, 1B, 1C, 1D, 1E:
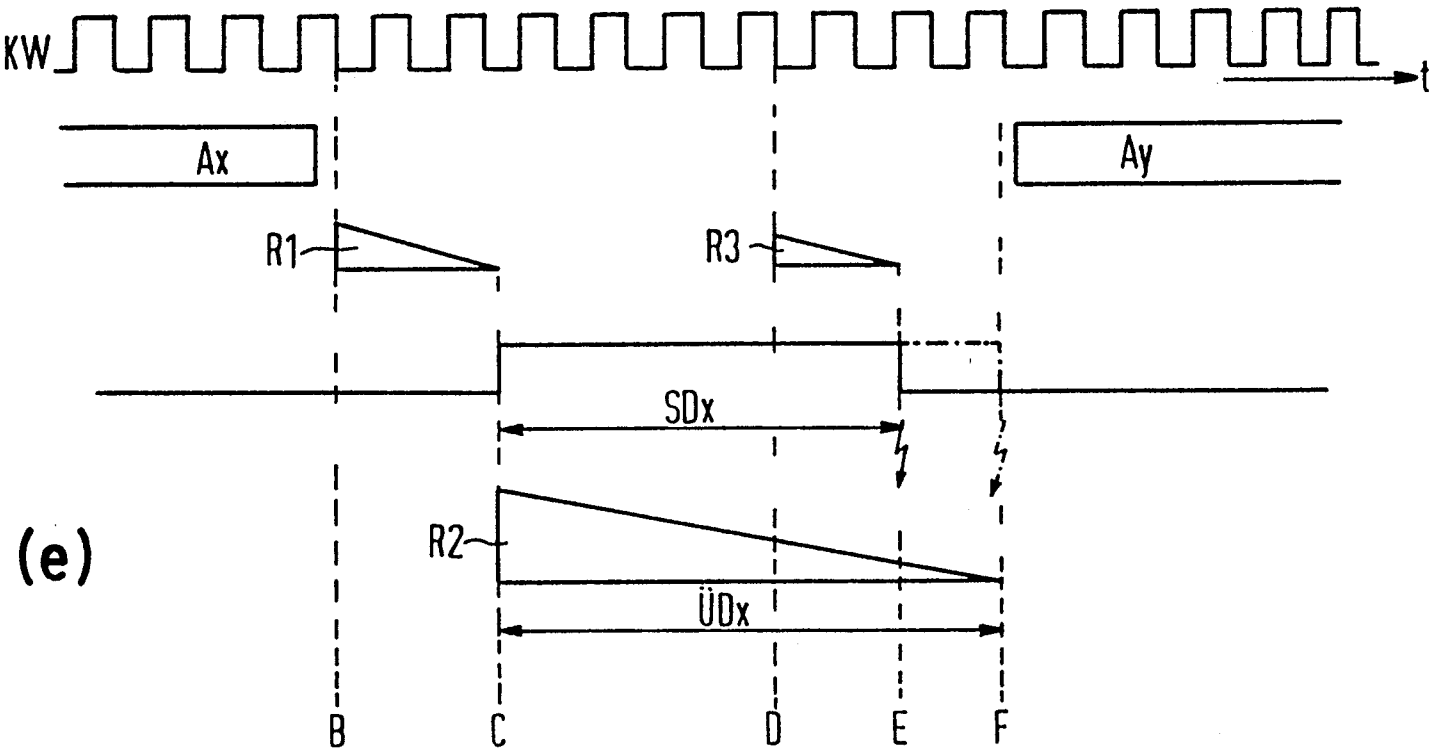

The invention relates to an ignition device for internal combustion engines having a monitoring device for a closing duration of a primary current circuit of at least one ignition coil, being set into motion simultaneously with an onset of closure of the primary current circuit and opening the primary current circuit again after a monitoring duration has elapsed, in the event that the circuit is still supposed to be closed at that time.

Such a device is described in German Published, Non-Prosecuted Application DE 39 24 129 Al, corresponding to Published International Application No. WO 91/01447.

A monitoring device for the closing duration of a primary current circuit of an ignition coil is known from the aforementioned prior art, in which the limiting duration of the closing time is variably adjusted as a function of the supply voltage.

The current intensity of the primary current circuit, which is dependent on the closing duration at the instant of injection, along with other factors, determines the current intensity and voltage of the ignition spark at the sparkplug.

The instant of activation of the primary current circuit, referred to the engine crankshaft position, is ascertained from the variables of the instant of ignition and the closing duration, which are calculated in a manner that is known per se.

If the closing durations are too long, the ignition coils and switching transistors are extremely heavily loaded, which can even lead to destruction from excessive temperatures.

Overly long closing durations can occur if the crankshaft position transducer should fail after the primary current circuit has been turned on, if there are software errors in the microprocessor forming the ignition device, or if highly negative engine rpm gradients occur during the closing duration.

In order to avoid overly long closing durations, monitoring devices are used. These devices should respond as fast as possible and terminate the closing duration if it persists too long.

In the known monitoring device, the monitoring or limiting duration is adjusted as a function of the supply voltage. Particularly at high engine rpm, this leads to disproportionately long monitoring times, because with a dependency only on the supply voltage, the longest closing duration, such as that occurring in engine idling, must accordingly be taken into account. A certain memory region in the microprocessor is also necessary for storing the supply-voltage-dependent table of the individual values for the monitoring duration.

It is accordingly an object of the invention to provide an ignition device for internal combustion engines, which overcomes the hereinafore-mentioned disadvantages of the heretofore-known devices of this general type and which does so in such a way that unnecessarily long monitoring durations cannot occur in any event, and that it is possible to economize on the occupation of memory spaces in the microprocessor.

With the foregoing and other objects in view there is provided, in accordance with the invention, in an ignition device for internal combustion engines having a monitoring device for a closing duration of a primary current circuit of at least one ignition coil, being set into motion simultaneously with an onset of closure of the primary current circuit and opening the primary current circuit again after a monitoring duration has elapsed, in the event that the circuit is still supposed to be closed at that time, the improvement comprising means for adjusting the monitoring duration as a function of the closing duration to be monitored.

The closing duration of modern ignition devices is in no way dependent solely on the supply voltage. Instead, it is also dependent on the engine rpm and the engine load. At high engine rpm, the closing duration is additionally limited, because overlapping activation times are not possible if there is only a single ignition coil, yet if there is more than one ignition coil, such overlapping times are not desired.

According to the invention, the monitoring duration is therefore adjusted as a function of the closing duration, and accordingly is always only slightly longer than the latter duration. By multiplying the closing duration by a constant factor, such as 1.25, for instance, this operation can be carried out very simply. Only an extremely small memory space is necessary, for one or a few program times.

Other features which are considered as characteristic for the invention are set forth in the appended claims.

Although the invention is illustrated and described herein as embodied in an ignition device for internal combustion engines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
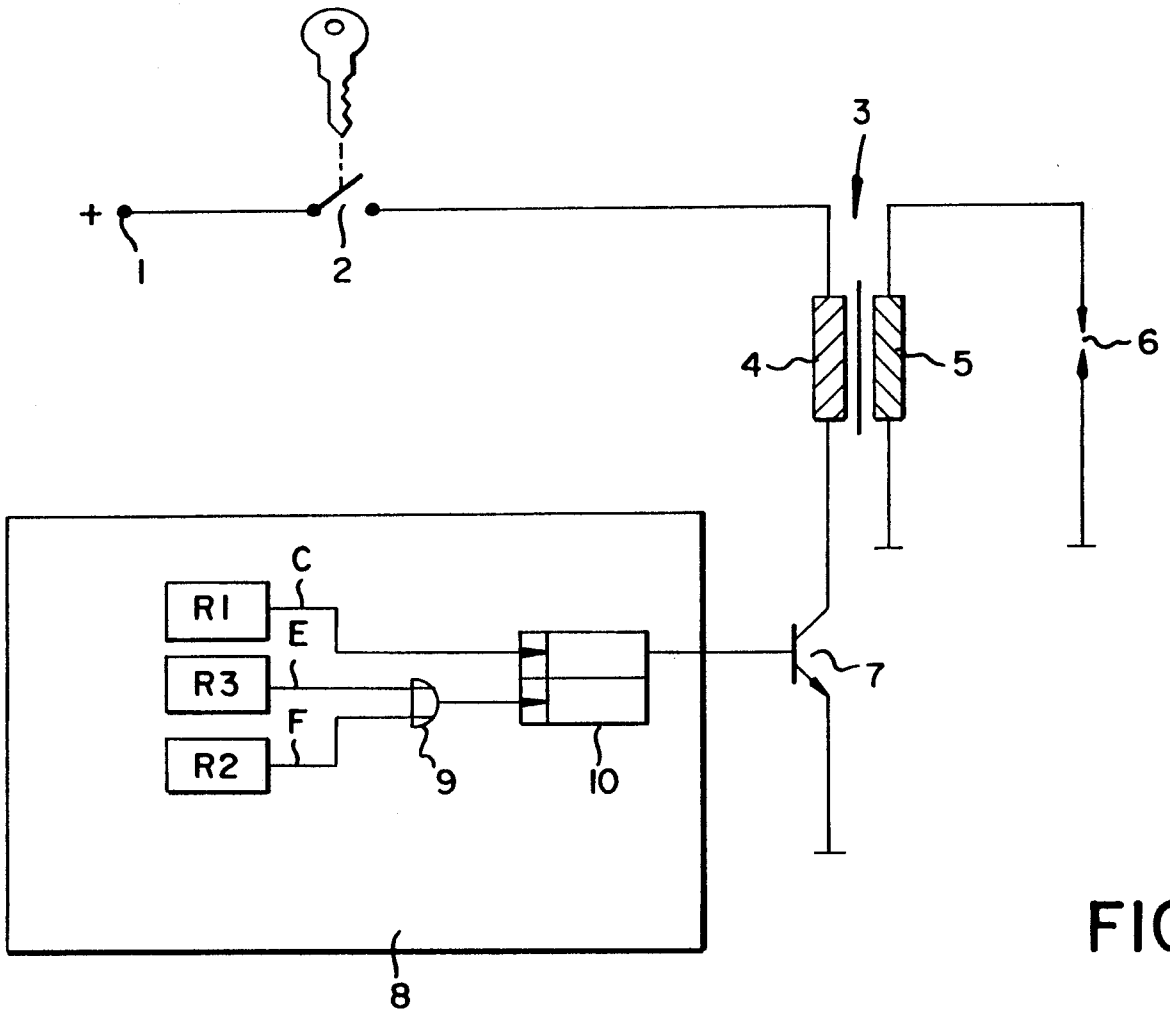

FIGS. 1*a–e* are diagrams, which is not to scale, showing the course over time of a closing duration SDx and a monitoring time ÜDx for a cylinder x of an internal combustion engine; and FIG. 2 is a schematic circuit diagram of an ignition device for an internal combustion engine.

Referring now to the figures of the drawing in detail and first, particularly, to FIG. 1 thereof, there is seen a line a), in which processed pulses KW of a position transducer connected to a crankshaft of the engine are shown. Intervals between the pulses correspond to a certain crankshaft angle KW. These pulses serve to ascertain the crankshaft angle and to calculate the rotary speed and acceleration of the engine crankshaft. As a rule, the counting for each cycle (two revolutions of the crankshaft, corresponding to a crankshaft angle KW of 720°) begins at a non-illustrated top dead center at the end of the compression stroke of a particular cylinder.

In a line b), calculation times Ax and Ay for the cylinder x in question and for a following cylinder y are shown. In the time Ax, the instant of ignition, closing duration and beginning of closing for the firing of the cylinder x are ascertained or calculated in a manner that is known per se from various engine operating parameters in a non-illustrated microprocessor, and corresponding data are fed to so-called compare registers. One respective register R1, R3 is loaded during the calculation time Ax with a certain number for each of the onset of closure and the instant of ignition, and beyond a predetermined crankshaft position (time B for the beginning of closure; time D for the instant of ignition), they are counted back down to zero by the internal clock of the microprocessor. At the instant at which the counter status of zero has been attained (time C for the onset of closure; time E for the instant of ignition), the corresponding command (closure or opening of the primary current circuit) is carried out.

The counter state of the registers R1 and R3 in each case is shown in the drawing in a line c).

A line d) shows the closing duration SDx, which begins at the time C when the register R1 runs out and ends at the time E when the register R3 runs out.

During the calculation time Ax, a further compare register R2 is also loaded (in a line e), and is started when the register R1 runs out, or in other words at time the C when the closing duration SDx begins. This register is adjusted in such a way that its transit time, which is determined by the internal microprocessor clock and is the monitoring duration ÜDx, is equivalent to 1.25 times the closing duration SDx, for instance.

As a result of one of the defects mentioned above (failure of the pulse of the crankshaft position transducer after starting of the register R1; microprocessor software errors; major negative engine rpm gradients in the range from C to D, etc.), it is possible that the register R3 will not start at the proper time, or may not even start at all.

If the primary current circuit is still on when the register R2 runs out (as is represented by dot-dash lines in a line d) at a time F, then at this moment the current circuit is opened and an ignition is initiated, as is represented by a lightning symbol at time the F shown in dot-dash lines (in contrast to the lightning symbol in solid lines at the proper instant of ignition at the time E).

The process then repeats again for the next cylinder y, beginning with the next calculation time Ay, and so forth, for all of the cylinders of on cycle (720° crankshaft angle KW) and for further cycles.

All of the dependencies on the supply voltage, rpm and load, and other possible parameters, by which the closing duration is determined, are implicitly taken into account in the monitoring duration, which is calculated as above.

As is seen in the ignition device for an internal combustion engine shown in FIG. 2, a primary current circuit extends from a positive pole 1 of an on-board electrical system, through an ignition switch 2 (represented by a key), a primary winding 4 of an ignition coil 3 and a power switch 7, to a negative pole of the on-board electrical system. A secondary current circuit is closed by a secondary winding 5 and a sparkplug 6. The power switch 7 is triggered by one output of a microprocessor 8. If it is made conducting, then the primary current circuit is closed. If it is made non-conducting, ignition in the sparkplug 6 takes place.

Among other elements, the microprocessor 8 has the three registers R1, R2 and R3 already described above. The circuit which is provided by software, can be represented schematically in hardware terms as is shown in FIG. 2. As is seen in FIG. 2, an OR element 9 is provided with inputs that are connected to outputs of the registers R2 and R3 and the OR element 9 is provided with an output that is connected to one input of a bistable flip-flop 10. Another input of the flip-flop 10 is connected to an output of the register R1 and output leads of the flip-flop 10 are connected to a control input of the power switch 7.

The registers R1, R2 and R3 are constructed in such a way that they output a pulse upon attaining a counter state of "zero" after a downward counting process. The respective outputs of the registers indicate the time (C, E or F corresponding to FIG. 1) when an output signal appears At the time C, the register R1 emits an output signal through which the flip-flop 10 is set and the primary current circuit is closed. If the register R3 emits a pulse at the time E, the flip-flop 10 is reset, the primary current circuit is opened, and a spark is produced in the sparkplug.

However, if this pulse remains absent at the time E, then after the monitoring duration ÜD corresponding to 1.25 times the closing duration SD, the register R2 emits a pulse at the time F that then replaces the absent pulse of the register R3 and in turn opens the primary current circuit.

We claim:

1. In an ignition device for internal combustion engines having a monitoring device for a closing duration of a primary current circuit of at least one ignition coil, being set into motion simultaneously with an onset of closure of the primary current circuit and opening the primary current circuit again after a monitoring duration has elapsed, in the event that the circuit is still supposed to be closed at that time, the improvement comprising:

means for adjusting the monitoring duration as a function of the closing duration to be monitored.

* * * * *